US011848125B2

(12) United States Patent
Guo et al.

(10) Patent No.: US 11,848,125 B2
(45) Date of Patent: Dec. 19, 2023

(54) RIBBON CABLE

(71) Applicants: Tyco Electronics (Shanghai) Co. Ltd, Shanghai (CN); TE Connectivity Services GmbH, Schaffhausen (CH)

(72) Inventors: Zhiwei (Jack) Guo, Dongguan (CN); Hainan (Harlan) Lu, Dongguan (CN); Jonathan Edward Lee, Middletown, PA (US)

(73) Assignees: Tyco Electronics (Shanghai) Co., Ltd., Shanghai (CN); TE Connectivity Solutions GmbH, Schaffhausen (CH)

( * ) Notice: Subject to any disclaimer, the term of this patent is extended or adjusted under 35 U.S.C. 154(b) by 0 days.

(21) Appl. No.: 17/747,457

(22) Filed: May 18, 2022

(65) Prior Publication Data

US 2022/0375647 A1 Nov. 24, 2022

(30) Foreign Application Priority Data

May 21, 2021 (CN) ..... 202110561955.4

(51) Int. Cl.
*H01B 7/08* (2006.01)
*H01B 7/02* (2006.01)

(52) U.S. Cl.
CPC ..... *H01B 7/0823* (2013.01); *H01B 7/0241* (2013.01); *H01B 7/0861* (2013.01); *H01B 7/0876* (2013.01)

(58) Field of Classification Search
CPC .... H01B 3/004; H01B 7/0838; H01B 7/0208; H01B 7/0241; H01B 7/0275; H01B 7/0045; H01B 11/002; H01B 11/02–11/05; H01B 11/07; H01B 11/08; H01B 11/183; H01B 11/20; H01B 11/203; H01B 13/14
USPC ..... 174/102 R, 106 R, 108, 109, 110 R, 174/113 R, 117 R, 117 F, 117 FF
See application file for complete search history.

(56) References Cited

U.S. PATENT DOCUMENTS

| | | | | |
|---|---|---|---|---|
| 4,481,379 | A * | 11/1984 | Bolick, Jr. | H01B 7/0838 174/117 F |
| 6,815,611 | B1 * | 11/2004 | Gareis | H01B 11/1025 174/113 R |
| 8,981,216 | B2 * | 3/2015 | Grant | H01B 11/06 174/113 R |
| 9,704,615 | B2 * | 7/2017 | Matsuda | H01B 11/183 |
| 2011/0247856 | A1 * | 10/2011 | Matsuda | H01B 11/203 174/108 |
| 2018/0075948 | A1 * | 3/2018 | Kobayashi | H01B 11/20 |
| 2019/0371491 | A1 * | 12/2019 | Ni | H01R 12/53 |
| 2019/0371499 | A1 * | 12/2019 | Huang | H01B 13/14 |
| 2022/0319736 | A1 * | 10/2022 | Guo | H01B 7/08 |

* cited by examiner

*Primary Examiner* — William H. Mayo, III
(74) *Attorney, Agent, or Firm* — Barley Snyder

(57) ABSTRACT

A ribbon cable includes a plurality of cable groups arranged side by side in a width direction of the ribbon cable and a wrapping film continuously wound on an outer side of the cable groups in a multi-turn wrapping manner at an inclined angle with respect to the width direction. There is a gap between every adjacent pair of cable groups.

17 Claims, 2 Drawing Sheets

RIBBON CABLE

CROSS-REFERENCE TO RELATED APPLICATION

This application claims the benefit of the filing date under 35 U.S.C. § 119(a)-(d) of Chinese Patent Application No. 202110561955.4, filed on May 21, 2021.

FIELD OF THE INVENTION

The present invention relates to a cable and, more particularly, to a ribbon cable.

BACKGROUND

In the related art, a high-speed data transmission ribbon cable such as a twinaxial cable mainly includes a plurality of cable groups arranged side by side, a covering film is provided on one side of the plurality of cable groups, and the plurality of cable groups are bonded to the covering film by hot melt adhesive on the covering film to form the ribbon cable. However, such a cable fixing structure of the existing ribbon cable is extremely unstable, and the cables easily fall off and become loose, which makes the assembly unusable. In addition, because the film is only attached to one side of these cable groups, the hot melt adhesive on the covering film is exposed to the air, is easily affected by the external environment, and is prone to failure, which is even more unfavorable for the fixing of the cable.

SUMMARY

A ribbon cable includes a plurality of cable groups arranged side by side in a width direction of the ribbon cable and a wrapping film continuously wound on an outer side of the cable groups in a multi-turn wrapping manner at an inclined angle with respect to the width direction. There is a gap between every adjacent pair of cable groups.

BRIEF DESCRIPTION OF THE DRAWINGS

The invention will now be described by way of example with reference to the accompanying Figures, of which.

DETAILED DESCRIPTION OF THE EMBODIMENTS

Figure 1:
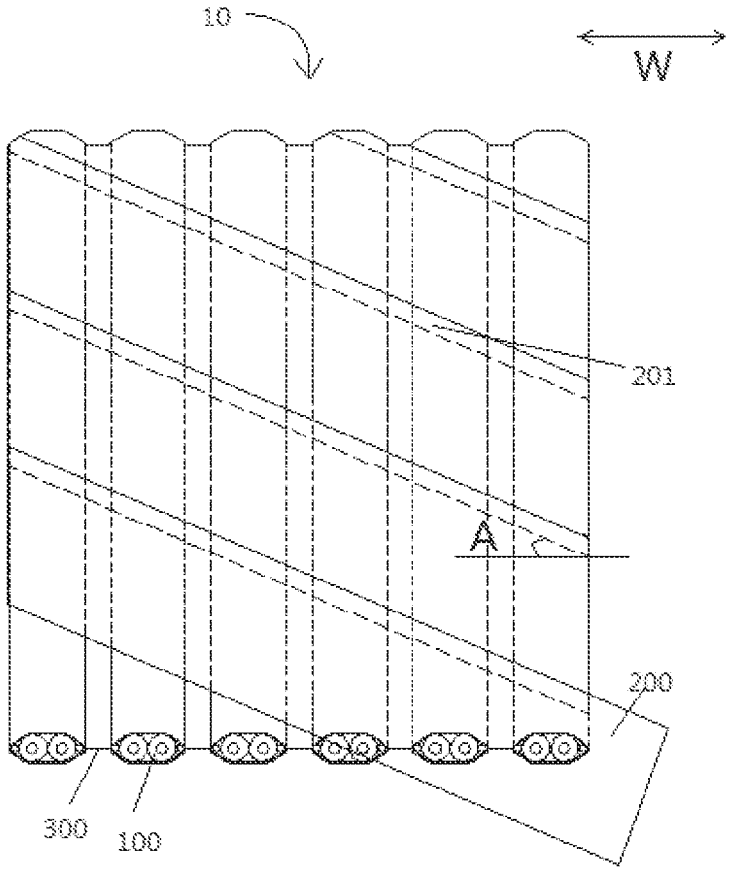
FIG. 1 is a perspective view of a ribbon cable according to an embodiment.

Embodiments of the present disclosure will be described hereinafter in detail taken in conjunction with the accompanying drawings. In the description, the same or similar parts are indicated by the same or similar reference numerals. The description of embodiments of the present disclosure hereinafter with reference to the accompanying drawings is intended to explain the general inventive concept of the present disclosure and should not be construed as a limitation on the present disclosure.

In addition, in the following detailed description, for the sake of explanation, numerous specific details are set forth in order to provide a thorough understanding of the disclosed embodiments. It will be apparent, however, that one or more embodiments may also be practiced without these specific details. In other instances, well-known structures and devices are illustrated schematically in order to simplify the drawing.

Figure 2:
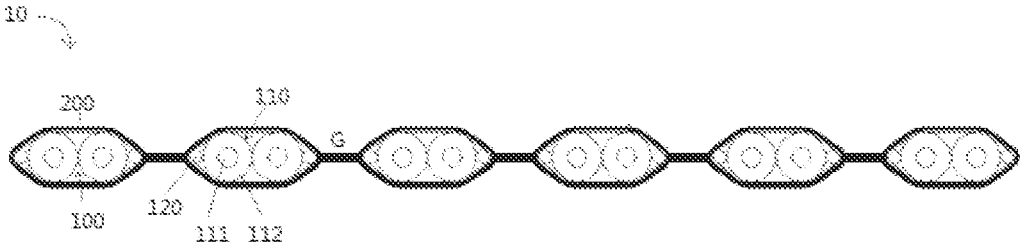
FIG. 2 is an elevation end view of the ribbon cable of FIG. 1.
Figure 3:
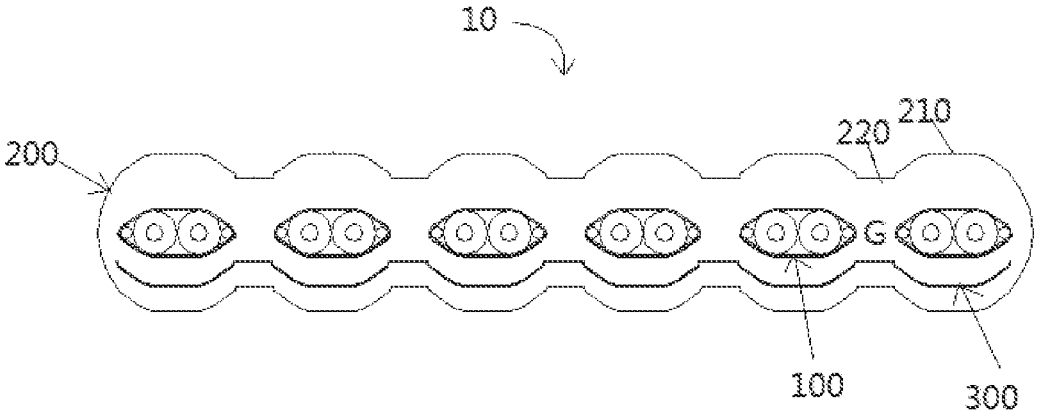
FIG. 3 is an exploded end view of the ribbon cable of FIG. 1.

In the embodiment shown in FIGS. 1 to 3, a ribbon cable 10 includes two or more cable groups 100 and the wrapping film 200. The two or more cable groups 100 are arranged side by side in the width direction W of the ribbon cable 10, and there is a gap G between every two adjacent cable groups 100. The wrapping film 200 is continuously wound on the outer side of the two or more cable groups 100 in a multi-turn wrapping manner at an inclined angle A with respect to the width direction W. It should be noted that the inclined angle A relative to the width direction W described here may be any suitable angle (for example, about 15 degrees, etc.), as long as it facilitates the winding of the wrapping film 200 on the cable groups 100.

As shown in FIG. 1, each turn wrapping portion of the wrapping film 200 has an overlapping portion 201 with another turn wrapping portion adjacent to the turn wrapping portion to provide better winding stability. According to the ribbon cable 10, the wrapping film 200 is wound on the outer side of the two or more cable groups 100 arranged side by side to form a stable double-sided fixing structure, so the cables do not easily fall off and become loose.

In the embodiment shown in FIGS. 1 to 3, a surface of the wrapping film 200 facing the two or more cable groups 100 is provided with hot melt adhesive, by which the wrapping film 200 is bonded to each cable group 100 of the two or more cable groups 100. That is, the wrapping film 200 may be bonded to the cable groups 100 by thermal fusion. However, it should be appreciated by those skilled in the art that, in some other embodiments of the present disclosure, the wrapping film 200 may be bonded to the cable groups 100 by an adhesive. According to the ribbon cable 10, since a double-sided fixing structure is adopted, the hot melt adhesive on the wrapping film 200 is not in contact with air, is less affected by the external environment, and is not prone to failure.

As shown in FIG. 3, the wrapping film 200 includes bonding portions 210 bonded onto each cable group 100 of the two or more cable groups 100 and spacing portions 220 located at the gap G. The spacing portion 220 on opposite sides of the two or more cable groups 100 are bonded to each other at the gap G to provide better fixing stability of the cable groups 100.

In the embodiment shown in FIGS. 1 and 3, the ribbon cable 10 further includes a covering film 300. The covering film 300 is arranged on one side of opposite sides of the two or more cable groups 100 and is bonded to each cable group 100 of the two or more cable groups 100. At this time, the wrapping film 200 covers the outer side of both the two or more cable groups 100 and the covering film 300. Specifically, a surface of the covering film 300 facing the two or more cable groups 100 is provided with hot melt adhesive, and the covering film 300 is bonded to each cable group 100 of the two or more cable groups 100 by the hot melt adhesive. However, it should be appreciated by those skilled in the art that in some other embodiments of the present disclosure, the covering film 300 may also be bonded to the cable groups 100 by an adhesive.

In another embodiment, the ribbon cable 10 may also be obtained by winding the wrapping film 200 on the outer side of the conventional ribbon cable in the related art. It should be appreciated by those skilled in the art that, in some other embodiments of the present disclosure, the ribbon cable 10 may not be provided with a covering film 300; that is, the wrapping film 200 may be directly wound on the cable groups 100 arranged side by side without the covering film 300.

In an embodiment, the wrapping film 200 includes a hot melt polyester tape, and the covering film 300 includes an insulation polyester tape or a shielding tape. That is, the wrapping film 200 and/or the covering film 300 may provide improved electromagnetic shielding for the cable groups 100, and may take the form of a layer/tape. The wrapping film 200 and/or the covering film 300 may be made of an insulation polymer material. For example, the wrapping film 200 and/or the covering film 300 may be made of an insulation material such as polyethylene terephthalate (abbreviated as "PET"). The wrapping film 200 and/or the covering film 300 may also be made of a metallic shielding material. For example, the wrapping film 200 and/or the covering film 300 may be made of a metal shielding material such as copper or aluminum. However, in some other embodiments of the present disclosure, the wrapping film 200 and/or the covering film 300 may also be made of other materials suitable for the fixing and shielding of high-speed cables.

As shown in FIG. 2, each cable group 100 of the two or more cable groups 100 includes: at least one insulation cable 110 including a core wire 111 and an insulation material layer 112 wrapped around the core wire 111, and/or at least one ground wire 120. Further, as shown in FIGS. 1 to 3, the at least one insulation cable 110 and/or the at least one ground wire 120 of each cable group 100 of the two or more cable groups 100 are wound together by an insulation covering film 130.

In other embodiments, the cable groups 100 may adopt one of the following combinations of the insulation cable 110 and/or the ground wire 120: single insulation cable 110, a plurality of insulation cables 110, single ground wire 120, a plurality of ground wires 120, a combination of single insulation cable 110 and a plurality of ground wires 120, a combination of a plurality of insulation cables 110 and single ground wire 120, and a combination of a plurality of insulation cables 110 and a plurality of ground wires 120. Moreover, the structures and combinations of the insulation cables 110 and/or the ground wires 120 of each cable group 100 of the ribbon cable 10 may be the same or different according to requirements.

In the embodiment shown in FIGS. 1 to 3, each cable group 100 of the two or more cable groups 100 includes two adjacent insulation cables 110 and one ground wire 120 on either side of the two adjacent insulation cables 110. Moreover, each cable group 100 of the ribbon cable 10 adopts the same structure and combination. For example, in the exemplary embodiment shown in FIGS. 1 to 3, the two or more cable groups 100 of the ribbon cables 10 include six cable groups 100. However, it should be noted that the number of the cable groups 100 of the ribbon cable 10 may vary according to the actual situation, for example, the number of the cable groups 100 may be two, three, four, five, seven or more. In addition, the structure and combination of each cable group 100 may be the same or different.

The ribbon cable 10 provided by the present disclosure may be a high-speed data transmission ribbon cable, such as a twinaxial cable.

Figure 4:
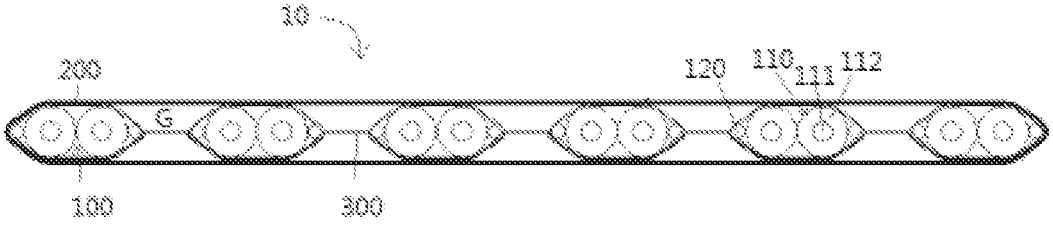
FIG. 4 is an elevation end view of a ribbon cable according to another embodiment.
Figure 5:
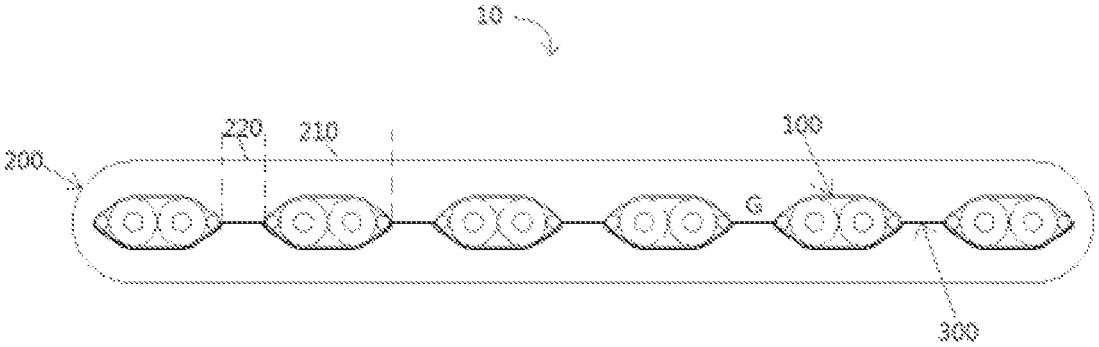
FIG. 5 is an exploded end view of the ribbon cable of FIG. 4.

A ribbon cable 10 according to another embodiment is shown in FIGS. 4 and 5. For the sake of brevity, only the components and/or structures in the exemplary embodiments shown in FIGS. 4 and 5 that are different from those in the exemplary embodiments shown in FIGS. 1 to 3 will be described below, and for the components and/or structures not described below, reference may be made to the above-related descriptions about the exemplary embodiments shown in FIGS. 1 to 3.

In the embodiment shown in FIGS. 4 and 5, the spacing portions 220 located on opposite sides of the two or more cable groups 100 are separated from each other at the gap G. For example, in the embodiment as shown in FIGS. 4 and 5, the height of the gap G is approximately equal to the diameter of the cable 110 of the cable groups 100, so as to provide external force buffering or vibration damping for the cable groups 100.

It should be appreciated by those skilled in this art that the above embodiments are intended to be illustrative, and many modifications may be made to the above embodiments by those skilled in this art. Further, various structures described in various embodiments may be freely combined with each other without conflicting in configuration or principle.

Although the present disclosure has been described hereinbefore in detail with reference to the accompanying drawings, it should be appreciated that the disclosed embodiments in the accompanying drawings are intended to illustrate the embodiments of the present disclosure by way of example, and should not be construed as a limitation to the present disclosure.

Although some embodiments of the general inventive concept of the present disclosure have been shown and described, it would be appreciated by those skilled in the art that changes or modification may be made to these embodiments without departing from the principles and spirit of the general inventive concept, the scope of which is defined in the claims and their equivalents.

What is claimed is:

1. A ribbon cable, comprising:

a plurality of cable groups arranged side by side in a width direction of the ribbon cable, wherein there is a gap between every adjacent pair of cable groups; and an insulating wrapping film continuously wound on an outer side of all of the cable groups in a multi-turn wrapping manner, to form a spiral wrap wherein a portion of the wrapping film continuously overlies a portion of the wrapping film beneath it, the wrapping being wound around the outer side at an inclined angle with respect to the width direction, whereby the outer side is completely covered and sealed.

2. The ribbon cable of claim 1, wherein the wrapping film has a width, and each of a plurality of multi-turn portions of the wrapping film has an overlapping portion with an adjacent portion that is a minor portion of the wrapping film width.

3. The ribbon cable of claim 1, wherein the wrapping film has a surface facing the cable groups, a hot melt adhesive is disposed on the surface and the wrapping film is bonded to each of the cable groups by the hot melt adhesive.

4. The ribbon cable of claim 1, wherein the wrapping film has a plurality of bonding portions bonded to each of the cable groups.

5. The ribbon cable of claim 4, wherein the wrapping film has a plurality of spacing portions each located at a gap between adjacent cable groups.

6. The ribbon cable of claim 5, wherein the spacing portions on opposite sides of the cable groups are separated from each other at a gap.

7. The ribbon cable of claim 5, wherein the spacing portions on opposite sides of the cable groups are bonded to each other at a gap.

8. The ribbon cable of claim 1, further comprising a covering film arranged on one of a pair of opposite sides of the cable groups and bonded to each of the cable groups.

9. The ribbon cable of claim 8, wherein the wrapping film covers an outer side of the cable groups and the covering film.

10. The ribbon cable of claim 8, wherein the covering film has a surface facing the cable groups, a hot melt adhesive is disposed on the surface and the covering film is bonded to each of the cable groups by the hot melt adhesive.

11. The ribbon cable of claim 8, wherein the covering film is an insulation polyester tape or a shielding tape.

12. The ribbon cable of claim 1, wherein the wrapping film is a hot melt polyester tape.

13. The ribbon cable of claim 1, wherein each of the cable groups has an insulation cable with a core wire and an insulation layer wrapped around the core wire.

14. The ribbon cable of claim 13, wherein each of the cable groups has a ground wire.

15. The ribbon cable of claim 14, wherein the insulation cable and the ground wire are wound together by an insulation film.

16. The ribbon cable of claim 1, wherein each of the cable groups has a pair of adjacent insulation cables and a ground wire located on either side of the adjacent insulation cables.

17. The ribbon cable of claim 1, wherein the plurality of cable groups are six cable groups.

* * * * *